US009837021B2

(12) United States Patent
Lee et al.

(10) Patent No.: US 9,837,021 B2
(45) Date of Patent: Dec. 5, 2017

(54) ORGANIC LIGHT EMITTING DISPLAY DEVICE

(71) Applicant: SAMSUNG DISPLAY CO., LTD., Yongin, Gyeonggi-Do (KR)

(72) Inventors: Jeongho Lee, Seoul (KR); Dohyun Kwon, Seongnam-si (KR); Su-Yeon Sim, Seoul (KR); Ju-Won Yoon, Hwaseong-si (KR); Gichang Lee, Hwaseong-si (KR); Seungmin Lee, Jeju-si (KR); Iljeong Lee, Seoul (KR); Choongyoul Im, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 182 days.

(21) Appl. No.: 14/738,622

(22) Filed: Jun. 12, 2015

(65) Prior Publication Data

US 2015/0379930 A1 Dec. 31, 2015

(30) Foreign Application Priority Data

Jun. 26, 2014 (KR) ..... 10-2014-0079067

(51) Int. Cl.
*G09G 3/3233* (2016.01)

(52) U.S. Cl.
CPC ... *G09G 3/3233* (2013.01); *G09G 2300/0861* (2013.01); *G09G 2310/0251* (2013.01); *G09G 2310/0262* (2013.01)

(58) Field of Classification Search
CPC ..... G09G 3/3233; G09G 2300/0861; G09G 2310/0251; G09G 2310/0262
See application file for complete search history.

(56) References Cited

U.S. PATENT DOCUMENTS 6,515,428 B1 2/2003 Yeh et al.
6,522,066 B2 2/2003 Sheu et al.
2009/0243977 A1* 10/2009 Chung ..... G09G 3/3233 345/76
2010/0178724 A1* 7/2010 Jung ..... H01L 27/3244 438/73
2011/0317500 A1* 12/2011 Uochi ..... G11C 11/404 365/189.011

(Continued)

FOREIGN PATENT DOCUMENTS

KR 10-2012-0008085 A 1/2012
KR 10-2013-0007214 A 1/2013
KR 10-2013-0040475 A 4/2013

*Primary Examiner* — Kent Chang
*Assistant Examiner* — Sujit Shah
(74) *Attorney, Agent, or Firm* — Lewis Roca Rothgerber Christie LLP

(57) ABSTRACT

An organic light emitting display device includes an (i−1)th pixel, an i-th pixel, and an (i+1)th pixel, each including an organic light emitting diode and a driving transistor to control a driving current flowing through the organic light emitting diode. A first node of the i-th pixel, to which a control electrode of the driving transistor of the i-th pixel is connected, is initialized to an initialization voltage in synchronization with an (i−1)th scan signal applied to the i-th pixel, and an anode of the organic light emitting diode of the i-th pixel is initialized to the initialization voltage in synchronization with an i-th scan signal applied to the (i+1)th pixel.

17 Claims, 18 Drawing Sheets

(56) References Cited

U.S. PATENT DOCUMENTS

| | | | | |
|---|---|---|---|---|
| 2012/0001893 | A1* | 1/2012 | Jeong | G09G 3/3233 345/213 |
| 2012/0001896 | A1* | 1/2012 | Han | G09G 3/3233 345/214 |
| 2013/0009154 | A1* | 1/2013 | Choi | H01L 27/124 257/59 |

* cited by examiner

ORGANIC LIGHT EMITTING DISPLAY DEVICE

CROSS-REFERENCE TO RELATED APPLICATION

This patent application claims priority to and the benefit of Korean Patent Application No. 10-2014-0079067, filed on Jun. 26, 2014, the content of which is hereby incorporated by reference in its entirety.

BACKGROUND

1. Field

The present disclosure relates to an organic light emitting display device. More particularly, the present disclosure relates to an organic light emitting display device having improved display quality.

2. Description of the Related Art

In general, an organic light emitting display device includes a plurality of pixels. Each pixel includes an organic light emitting diode and a circuit part to control the organic light emitting diode. The circuit part includes a switching transistor, a driving transistor, and a storage capacitor.

The organic light emitting diode includes an anode, a cathode, and an organic light emitting layer disposed between the anode and the cathode. The organic light emitting diode emits light when a voltage greater than a threshold voltage is applied to the organic light emitting layer.

SUMMARY

The present disclosure provides an organic light emitting display device capable of displaying a uniform black brightness.

Embodiments of the inventive concept provide an organic light emitting display device including an (i−1)th (i is a natural number equal to or greater than 2) pixel connected to an (i−1)th scan line, an i-th pixel connected to an i-th scan line, and an (i+1)th pixel connected to an (i+1)th scan line. Each of the (i−1)th pixel, the i-th pixel, and the (i+1)th pixel includes an organic light emitting diode and a driving transistor that controls a driving current flowing through the organic light emitting diode. A first node of the i-th pixel, to which a control electrode of the driving transistor of the i-th pixel is connected, is initialized to an initialization voltage in synchronization with an (i−1)th scan signal applied to the i-th pixel, and an anode of the organic light emitting diode of the i-th pixel is initialized to the initialization voltage in synchronization with an i-th scan signal applied to the (i+1)th pixel.

In certain embodiments, the i-th pixel further includes a first initialization transistor and a second initialization transistor, which are connected between an i-th initialization line applied with the initialization voltage and the first node of the i-th pixel in series. The first and second initialization transistors of the i-th pixel apply the initialization voltage to the first node of the i-th pixel in response to the (i−1)th scan signal applied to an i-th dummy scan line.

In certain embodiments, a first node of the (i+1)th pixel, to which a control electrode of the driving transistor of the (i+1)th pixel is connected, is initialized to the initialization voltage in synchronization with the i-th scan signal applied to the (i+1)th pixel.

In certain embodiments, the (i+1)th pixel further includes a first initialization transistor and a second initialization transistor, which are connected between an (i+1)th initialization line applied with the initialization voltage and the first node of the (i+1)th pixel in series. A second node of the (i+1)th pixel, which is connected to the anode of the organic light emitting diode of the i-th pixel, is defined between the first and second initialization transistors of the (i+1)th pixel. The first initialization transistor of the (i+1)th pixel applies the initialization voltage to the second node of the (i+1)th pixel in response to the i-th scan signal applied to the (i+1)th pixel, and the anode of the organic light emitting diode of the i-th pixel is connected to the second node of the (i+1)th pixel.

In certain embodiments, a second node of the i-th pixel, which is connected to the anode of the organic light emitting diode of the (i−1)th pixel, is defined between the first and second initialization transistors of the i-th pixel. The anode of the organic light emitting diode of the (i−1)th pixel is initialized to the initialization voltage in synchronization with the (i−1)th scan signal applied to the i-th pixel.

In certain embodiments, the second initialization transistor of the i-th pixel includes two transistors connected between the second node of the i-th pixel and the first node of the i-th pixel.

In certain embodiments, the i-th pixel includes a switching transistor, a storage capacitor, and first and second control transistors. The switching transistor includes an input electrode connected to a k-th (k is a natural number equal to or greater than 1) data line, an output electrode connected to an input electrode of the driving transistor, and a control electrode connected to the i-th scan line applied with the i-th scan signal. The storage capacitor is connected between the first node and a power source line.

In certain embodiments, the first control transistor includes an input electrode connected to an output electrode of the driving transistor, an output electrode connected to the first node, and a control electrode connected to the i-th scan line applied with the i-th scan signal. The second control transistor includes an input electrode connected to the output electrode of the driving transistor, an output electrode connected to the anode of the organic light emitting diode, and a control electrode connected to an i-th light emitting line.

In certain embodiments, the i-th pixel further includes a third control transistor including an input electrode connected to the power source line, an output electrode connected to the input electrode of the driving transistor, and a control electrode connected to the i-th light emitting line.

In certain embodiments, a period in which the (i−1)th scan signal applied to the i-th dummy scan line is activated corresponds to an initialization period, and a period in which the i-th scan signal applied to the i-th scan line is activated corresponds to a data write-in period after the initialization period. The storage capacitor is charged with a voltage corresponding to a data signal applied to the k-th data line during the data write-in period.

In certain embodiments, a period in which a light emitting control signal applied to the i-th light emitting line is activated corresponds to a light emitting period after the initialization period, and the organic light emitting diode of the i-th pixel emits a light in response to the voltage charged in the storage capacitor during the light emitting period.

In certain embodiments, a channel part of the driving transistor is disposed between the input electrode of the driving transistor and the output electrode of the driving transistor. The channel part of the driving transistor is disposed on a same layer as the input and output electrodes of the driving transistors and overlapped with the control electrode of the driving transistor.

In certain embodiments, the storage capacitor includes a first electrode disposed on a first insulating layer that covers the input electrode, the output electrode, and the channel part of the driving transistor and a second electrode disposed on a second insulating layer that covers the first electrode and is connected to the power source line.

In certain embodiments, the driving transistor further includes a floating electrode disposed on a same layer as the first electrode and overlapped with the control electrode of the driving transistor.

In certain embodiments, the control electrode of the driving transistor is disposed on a same layer as the second electrode.

In certain embodiments, the i-th pixel includes a first connection electrode to connect the control electrode of the driving transistor and the first electrode of the storage capacitor. The first connection electrode is disposed on a third insulating layer that covers the control electrode of the driving transistor. The first connection electrode is connected to the control electrode of the driving transistor through a first contact hole formed through the third insulating layer, and the first connection electrode is connected to the first electrode of the storage capacitor through a second contact hole formed through the third and second insulating layers.

In certain embodiments, the i-th pixel further includes a second connection electrode connected to an output electrode of the second control transistor. The output electrode of the second control transistor is disposed on a same layer as the output electrode of the driving transistor. The second connection electrode is disposed on the third insulating layer. The second connection electrode is connected to the output electrode of the second control transistor through a third contact hole formed through the first, second, and third insulating layers.

In certain embodiments, the anode of the organic light emitting diode is disposed on a fourth insulating layer that covers the second connection electrode. The second connection electrode is connected to the anode of the organic light emitting diode through a fourth contact hole formed through the fourth insulating layer.

According to one or more of the above embodiments, the anode of the organic light emitting diode is discharged to the initialization voltage before the organic light emitting diode emits the light. Then, the organic light emitting diode emits the light in response to the data signal. The organic light emitting diode displays brightness corresponding to a gray-scale value of the data signal. When the data signal has the black gray-scale level, the organic light emitting diode displays the black color without malfunctioning. The organic light emitting diode displays low gray-scale levels each having a set or predetermined brightness difference against the black color.

BRIEF DESCRIPTION OF THE DRAWINGS

The above and other advantages of the present disclosure will become readily apparent by reference to the following detailed description when considered in conjunction with the accompanying drawings wherein.

DETAILED DESCRIPTION

Figure 1:
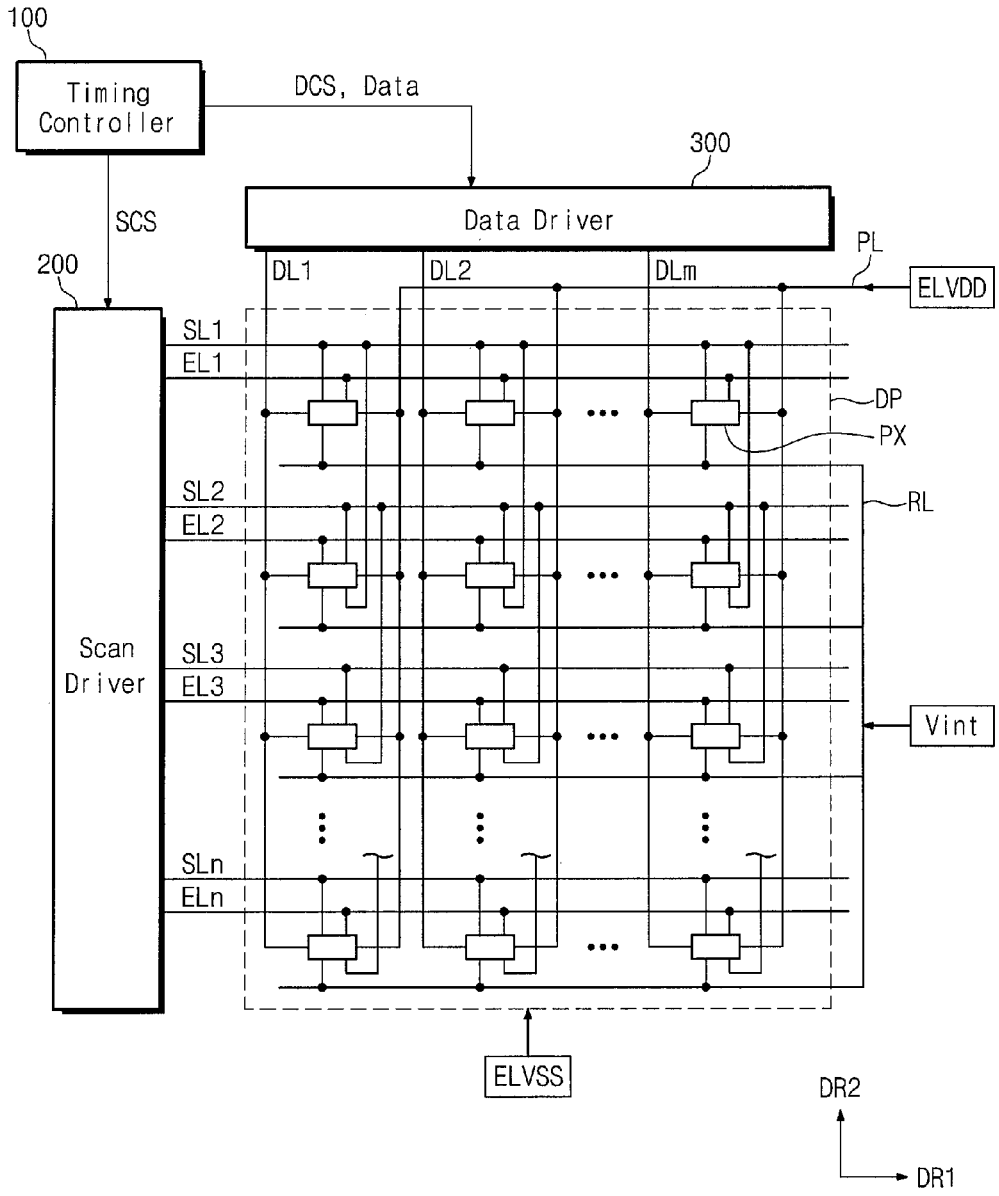
FIG. 1 is a block diagram showing an organic light emitting display device according to an exemplary embodiment of the present disclosure.

It will be understood that when an element or layer is referred to as being "on", "connected to" or "coupled to" another element or layer, it can be directly on, connected or coupled to the other element or layer, or one or more intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein. Further, the use of "may" when describing embodiments of the present invention refers to "one or more embodiments of the present invention."

Hereinafter, the present invention will be explained in more detail with reference to the accompanying drawings.

FIG. 1 is a block diagram showing an organic light emitting display device according to an exemplary embodiment of the present disclosure.

Referring to FIG. 1, the organic light emitting display device includes a timing controller 100, a scan driver 200, a data driver 300, and an organic light emitting display panel DP.

The timing controller 100 receives input image signals and coverts a data format of the input image signals to a data format appropriate to an interface between the data driver 300 and the timing controller 100 to generate image data RGB. The timing controller 100 outputs the image data RGB and various control signals DCS and SCS.

The scan driver 200 receives a scan control signal SCS from the timing controller 100. The scan control signal SCS includes a vertical start signal that starts an operation of the scan driver 200 and a clock signal that determines an output timing of signals. The scan driver 200 generates a plurality of scan signals and sequentially applies the scan signals to a plurality of scan lines SL1 to SLn described later in more detail. The scan driver 200 generates a plurality of light emitting control signals in response to the scan control signal SCS and applies the light emitting control signals to a plurality of light emitting lines EL1 to ELn described later in more detail.

In FIG. 1, the scan signals and the light emitting control signals are output from one scan driver 200, but the number of the scan driver 200 should not be limited to one. According to embodiments, the scan signals and the light emitting control signals may be output through plural scan drivers. In addition, a driving circuit that generates the scan signals and a driving circuit that generates the light emitting control signals may be separately prepared.

The data driver 300 receives the data control signal DCS and the image data RGB from the timing controller 100. The data driver 300 converts the image data RGB to data signals and applies the data signals to a plurality of data lines DL1 to DLm described later. The data signals are analog signals corresponding to gray-scale levels of the image data RGB.

The organic light emitting display panel DP includes the scan lines SL1 to SLn, the light emitting lines EL1 to ELn, the data lines DL1 to DLm, and the pixels PX. The scan lines SL1 to SLn extend along a first direction DR1 and are arranged in a second direction DR2 crossing (or substantially perpendicular to) the first direction DR1. Each of the light emitting lines EL1 to ELn is arranged substantially in parallel to a corresponding scan line of the scan lines SL1 to SLn. The data lines DL1 to DLm are insulated from the scan lines SL1 to SLn while crossing the scan lines SL1 to SLn.

Each of the pixels PX is connected to a corresponding scan line of the scan lines SL1 to SLn, a corresponding light emitting line of the light emitting lines EL1 to ELn, and a corresponding data line of the data lines DL1 to DLm. Each of the pixels PX receives a first voltage ELVDD and a second voltage ELVSS having a voltage level lower than that of the first voltage ELVDD. Each of the pixels PX is connected to a power source line PL applied with the first voltage ELVDD. Each of the pixels PX is connected to an initialization line RL applied with an initialization voltage Vint.

Each of the pixels PX is electrically connected to two scan lines. As shown in FIG. 1, the pixels PX (hereinafter, referred to as second pixel row pixels) connected to a second scan line SL2 may be connected to a first scan line SL1. The second pixel row pixels PX receive the scan signal applied to the second scan line SL2 and the scan signal applied to the first scan line SL1.

Although not shown in FIG. 1, the organic light emitting display panel DP may further include a plurality of dummy scan lines. In addition, the organic light emitting display panel DP may further include a scan line to apply the initialization control signal to the pixels PX connected to the first scan line SL1. Further, the pixels (hereinafter, referred to as pixel column pixels) connected to the same data line among the data lines may be connected to each other. Among the pixel column pixels, two pixels adjacent to each other may be electrically connected to each other.

Each of the pixels PX includes an organic light emitting diode and a circuit part that controls a light emission of the organic light emitting diode. The circuit part includes a plurality of thin film transistors (hereinafter, referred to as transistors) and a capacitor. The pixels PX include red pixels for representing a red color, green pixels for representing a green color, and blue pixels for representing a blue color. The organic light emitting diode of the red pixel, the organic light emitting diode of the green pixel, and the organic light emitting diode of the blue pixel may include different organic light emitting layers formed of different materials.

The scan lines SL1 to SLn, the light emitting lines EL1 to ELn, the data lines DL1 to DLm, the power source line PL, the initialization line RL, and the pixels PX are formed on a base substrate through several photolithography processes. A plurality of insulating layers may be formed on the base substrate through several deposition processes or coating processes. The insulating layers are configured to include organic and/or inorganic layers. A sealing layer may be further formed on the base substrate to protect the pixels PX.

Figure 2:
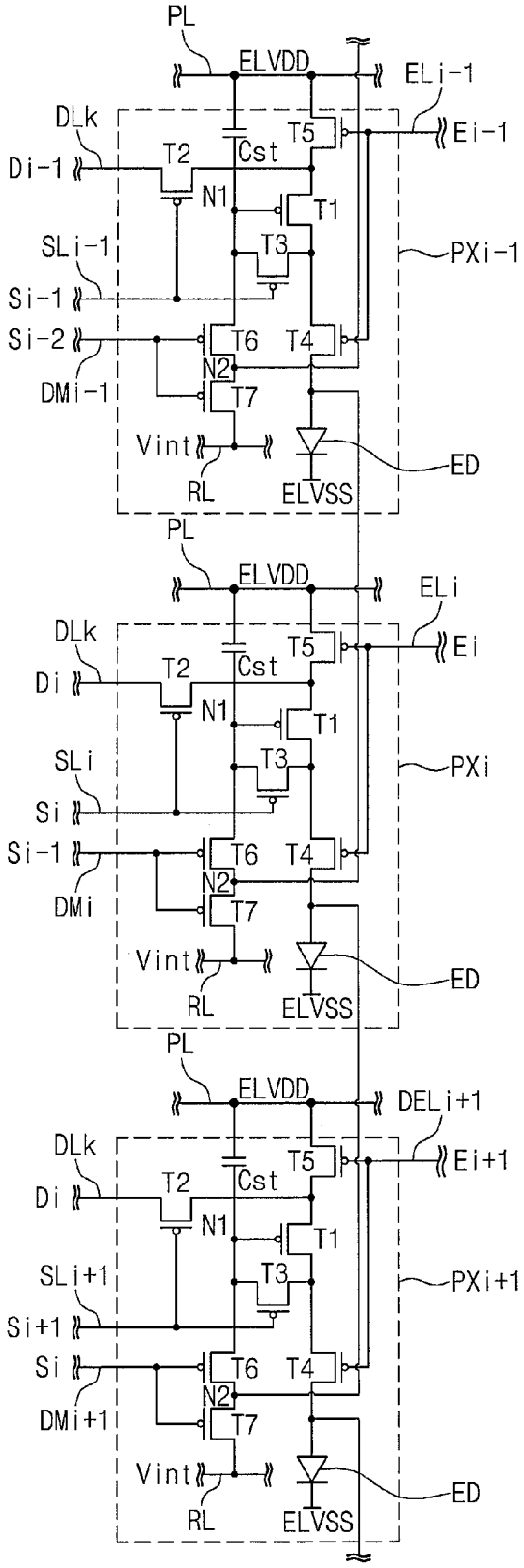
FIG. 2 is a circuit diagram showing pixels according to an exemplary embodiment of the present disclosure.
Figure 3:
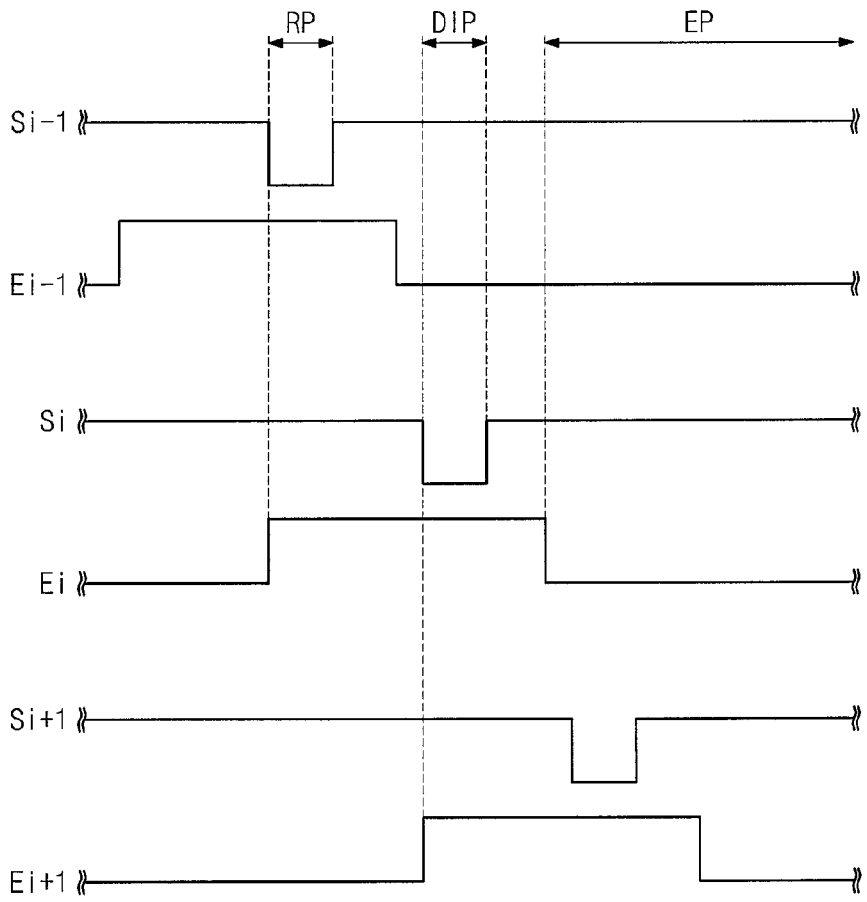
FIG. 3 is a waveform diagram showing driving signals used (utilized) to drive the pixels shown in FIG. 2.

FIG. 2 is a circuit diagram showing the pixels according to an exemplary embodiment of the present disclosure, FIG. 3 is a waveform diagram showing driving signals used to drive the pixels shown in FIG. 2, and FIGS. 4A to 4C are circuit diagrams showing an operation of an i-th pixel in accordance with the driving signals.

FIG. 2 shows first, second, and third pixels PXi−1, PXi, and PXi+1 connected to a k-th data line DLk among the data lines DL1 to DLm. The first, second, and third pixels PXi−1, PXi, and PXi+1 have the same configuration and function, and thus the second pixel PXi will be mainly described.

The second pixel PXi includes the organic light emitting diode ED and the circuit part to control the organic light emitting diode ED. In the present exemplary embodiment, the circuit part includes seven transistors T1 to T7 and one capacitor Cst and the seven transistors T1 to T7 are a p-type (p-channel) transistor, but the configuration of the circuit part should not be limited to that shown in FIG. 2.

Referring to FIG. 2, the circuit part includes a first transistor T1 connected between the power source line PL and the anode of the organic light emitting diode ED, a second transistor T2 connected between the k-th data line DLk and the first transistor T1, a third transistor T3 connected between a first node N1 and an output electrode of the first transistor T1, a fourth transistor T4 connected between the first transistor T1 and the anode of the organic light emitting diode ED, and a fifth transistor T5 connected between the power source line PL and the first transistor T1. In addition, the circuit part includes a sixth transistor T6 and a seventh transistor T7, which are connected between the first node N1 and the initialization line RL in series. The circuit part includes the storage capacitor Cst connected between the first node N1 and the power source line PL.

In more detail, the first transistor T1 includes an input electrode applied with the first voltage ELVDD through the fifth transistor T5, and a control electrode and the output electrode, which are connected to the first node N1. The output electrode of the first transistor T1 applies the first voltage ELVDD to the organic light emitting diode ED through the fourth transistor T4. The output electrode of the first transistor T1 is connected to the first node N1 through the third transistor T3.

The first transistor T1 controls a driving current applied to the organic light emitting diode ED in response to an electric potential of the first node N1. The first transistor T1 may serve as a driving transistor.

The second transistor T2 includes an input electrode connected to the k-th data line DLk, a control electrode connected to the i-th scan line SLi, and an output electrode connected to the input electrode of the first transistor T1. The second transistor T2 is turned on in response to the scan signal Si (hereinafter, referred to as an i-th scan signal) applied to the i-th scan line SLi and applies a data signal Di applied to the k-th data line DLk to the storage capacitor Cst. The second transistor T2 may serve as a switching transistor. The control electrodes of the second transistors T2 of the first and third pixels PXi−1 and PXi+1 are respectively connected to the (i−1)th scan line SLi−1 and the (i+1)th scan line SLi+1.

The third transistor T3 includes an input electrode connected to the output electrode of the first transistor T1, a control electrode connected to the i-th scan line SLi, and an output electrode connected to the first node N1. The third transistor T3 is turned on in response to the i-th scan signal Si. The third transistor T3 may serve as a first control transistor. The control electrodes of the third transistors T3 of the first and third pixels PXi−1 and PXi+1 are respectively connected to the (i−1)th scan line SLi−1 and the (i+1)th scan line SLi+1.

When the second and third transistors T2 and T3 are turned on, the first transistor T1 is connected between the second and third transistors T2 and T3 in a diode form (or as a diode). Accordingly, the second transistor T2 is connected to the first node N1 through the first and third transistors T1 and T3.

The storage capacitor Cst is connected between the power source line PL and the first node N1. The storage capacitor Cst is charged with a voltage corresponding to the voltage applied to the first node N1.

The fourth transistor T4 includes an input electrode connected to the output electrode of the first transistor T1, a control electrode connected to the i-th light emitting line ELi, and an output electrode connected to the anode of the organic light emitting diode ED. The fourth transistor T4 is switched in response to the light emitting control signal Ei (hereinafter, referred to as an i-th light emitting control signal) provided from the i-th light emitting line ELi.

The fifth transistor T5 includes an input electrode connected to the power source line PL, a control electrode connected to the i-th light emitting line ELi, and an output electrode connected to the input electrode of the first transistor T1. The fifth transistor T5 is switched in response to the i-th light emitting control signal Ei.

A current path is formed or not between the power source line PL and the organic light emitting diode ED according to the operation of the fourth and fifth transistors T4 and T5. The fourth transistor T4 may serve as a second control transistor and the fifth transistor T5 may serve as a third control transistor. In the present exemplary embodiment, one of the fourth and fifth transistors T4 and T5 may be omitted.

The control electrodes of the fourth and fifth transistors T4 and T5 of the first pixel PXi−1 are connected to the (i−1)th light emitting line ELi−1. In addition, the control electrodes of the fourth and fifth transistors T4 and T5 of the third pixel PXi+1 are connected to the (i+1)th light emitting line Eli+1.

The sixth transistor T6 includes an input electrode connected to an output electrode of the seventh transistor T7, a control electrode applied with the initialization control signal Si−1, and an output electrode connected to the first node N1. The seventh transistor T7 includes an input electrode connected to the initialization line RL, a control electrode applied with the initialization control signal Si−1, and the output electrode connected to the input electrode of the sixth transistor T6.

The control electrodes of the sixth and seventh transistors T6 and T7 are connected to an i-th dummy scan line DMi. The sixth and seventh transistors T6 and T7 are turned on in response to the initialization control signal Si−1 applied to the i-th dummy scan line DMi. In the present exemplary embodiment, the initialization control signal Si−1 may be substantially the same as the (i−1)th scan signal Si−1 applied to the (i−1)th scan line SLi−1. The i-th dummy scan line DMi may be electrically connected to the (i−1)th scan line SLi−1.

The sixth transistor T6 may serve as a first initialization transistor, and the seventh transistor T7 may serve as a second initialization transistor. When the sixth and seventh transistors T6 and T7 are turned on, the first node N1 is initialized by the initialization voltage Vint. In the present exemplary embodiment, the sixth transistor T6 may be omitted.

A point, at which the input electrode of the sixth transistor T6 and the output electrode of the seventh transistor T7 make contact with each other, is referred to as a second node N2. The second node N2 is connected to the anode of the organic light emitting diode ED of the first pixel PXi−1. Therefore, the anode of the organic light emitting diode ED of the first pixel PXi−1 is initialized by the initialization voltage Vint when the seventh transistor T7 of the second pixel PXi is turned on.

The anode of the organic light emitting diode ED of the second pixel PXi is connected to the second node N2 of the third pixel PXi+1. The control electrodes of the sixth and seventh transistors T7 of the third pixel PX+1 are connected to the (i+1)th dummy scan line DMi+1. The seventh transistor T7 of the third pixel PXi+1 is turned on in response to the initialization control signal Si applied to the (i+1)th dummy scan line DMi+1. The initialization control signal Si may be substantially the same as the i-th scan signal Si. Thus, the anode of the organic light emitting diode ED of the second pixel PXi is initialized by the initialization voltage Vint when the seventh transistor T7 of the third pixel PXi+1 is turned on.

Consequently, the first node N1 of the second pixel PXi is initialized to the initialization voltage Vint in response to the (i−1)th scan signal Si−1 applied to the second pixel PXi, and the anode of the organic light emitting diode ED of the second pixel PXi is initialized to the initialization voltage Vint in response to the i-th scan signal Si applied to the third pixel PXi+1.

Hereinafter, the operation of the i-th pixel will be described in more detail with reference to FIGS. 3 and 4A to 4C. The organic light emitting display panel DP (refer to FIG. 1) displays the image every frame period. During each frame period, the scan lines SL1 to SLn are sequentially scanned by the scan signals. FIG. 3 shows a portion of one frame period.

Figure 4A:
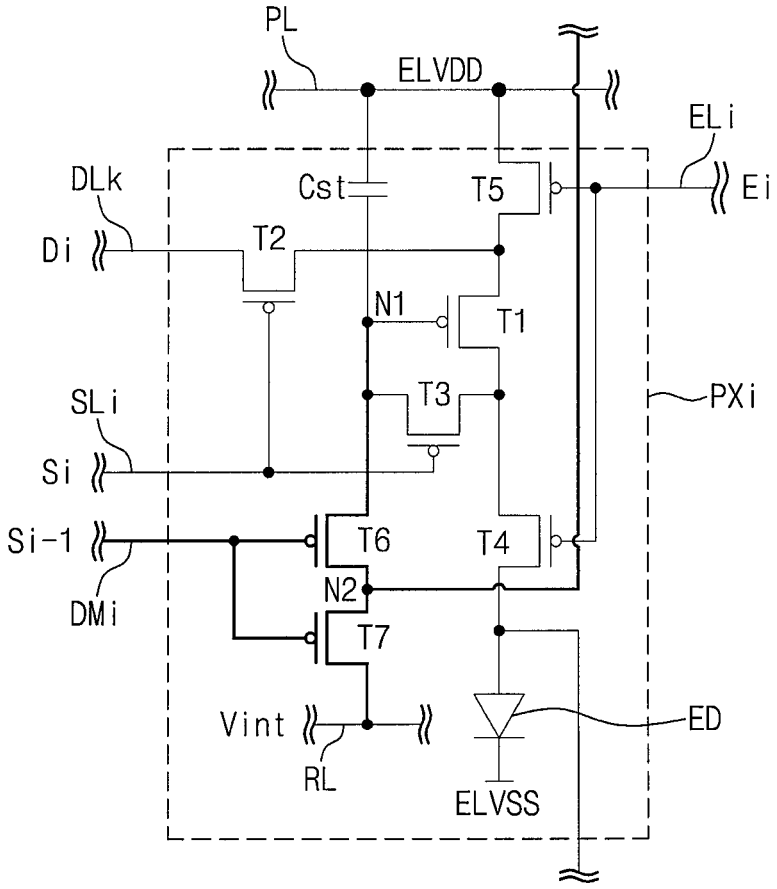
FIGS. 4A to 4C are circuit diagrams showing an operation of an i-th pixel in accordance with the driving signals.

Referring to FIGS. 3 and 4A, the initialization control signal Si−1 applied to the i-th dummy scan line DMi is activated in an initialization period RP. In the present exemplary embodiment, the signals shown in FIG. 3 are activated at a low level. The low level of the signals shown in FIG. 3 may be a turn-on voltage of the transistors respectively applied with the signals.

When the sixth and seventh transistors T6 and T7 are turned on by the initialization control signal Si−1, the initialization voltage Vint is applied to the first node N1. The first node N1 of the second pixel PXi is initialized to the initialization voltage Vint. The initialization voltage Vint has a voltage level lower than a data signal having a highest gray-scale level by the threshold voltage of the first transistor T1 or more, which is enough to initialize the first node N1.

In this case, the initialization voltage Vint is applied to the anode of the organic light emitting diode ED of the first pixel PXi−1 (refer to FIG. 2) through the second node N2. Accordingly, the anode of the organic light emitting diode ED of the first pixel PXi−1 and the first node N1 of the second pixel PXi are concurrently or substantially simultaneously initialized.

Figure 4B:
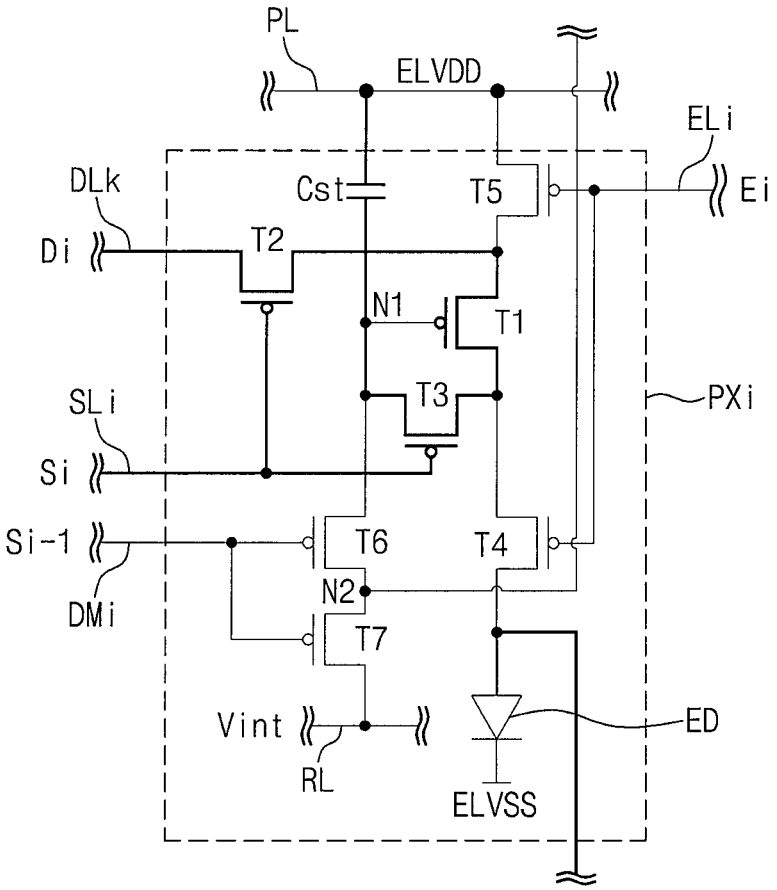

Referring to FIGS. 3 and 4B, the i-th scan signal Si applied to the i-th scan line SLi is activated in a data write-in period DIP following the initialization period RP. The second and third transistors T2 and T3 are turned on by the scan signal Si activated in the data write-in period DIP, and the first transistor T1 is connected to between the second and third transistors T2 and T3 in the diode.

During the data write-in period DIP, the data signal Di is applied to the k-th data line DLk. The data signal Di is applied to the first node N1 through the second transistor T2, the first transistor T1, and the third transistor T3. In this case, since the first transistor T1 is connected between the second and third transistors T2 and T3 in the diode, a difference voltage between the data signal Di and the threshold voltage of the first transistor T1 is applied to the first node N1. The voltage applied to the first node N1 is charged in the storage capacitor Cst during the data write-in period DIP.

In this case, the anode of the organic light emitting diode ED is initialized to the initialization voltage Vint output from the second node N2 of the third pixel PXi+1 (refer to FIG. 2). That is, the voltage corresponding to the data signal Di is charged in the storage capacitor Cst, and concurrently or substantially simultaneously, the organic light emitting diode ED of the second pixel PXi is initialized.

The initialization voltage Vint discharges a parasitic capacitance of the organic light emitting diode ED. A difference in electric potential between the initialization voltage Vint and the second voltage ELVSS applied to the cathode of the organic light emitting diode ED is smaller than the light emitting threshold voltage of the organic light emitting diode ED. Therefore, the mis-emission of the organic light emitting diode ED is reduced or prevented.

Figure 4C:
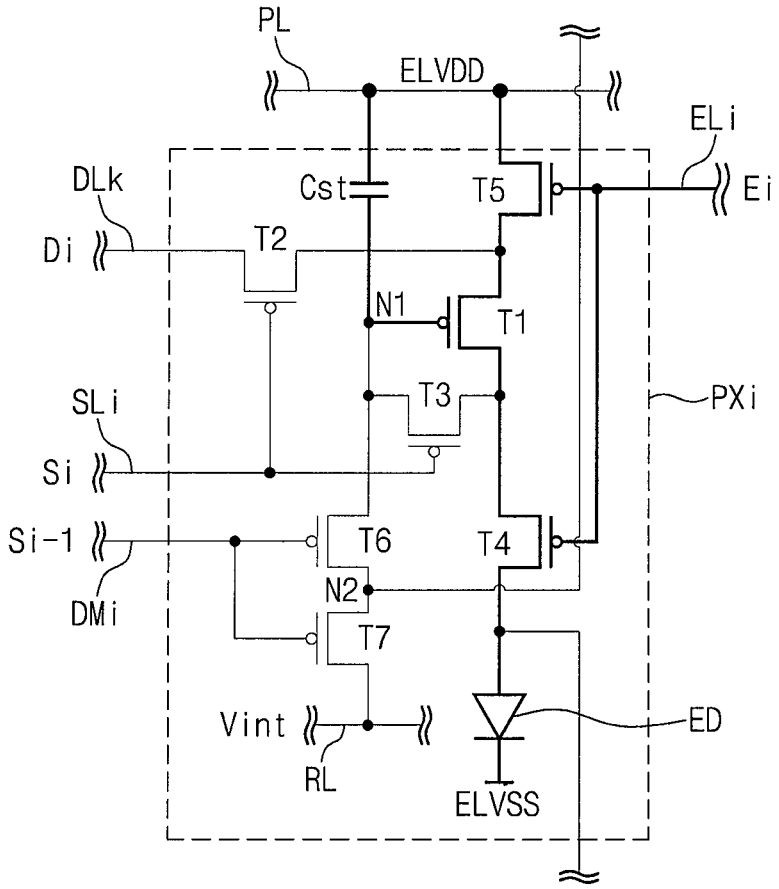

Referring to FIGS. 3 and 4C, the i-th light emitting control signal Ei, which is inactivated in the initialization period RP and the data write-in period DIP, is activated in a light emitting period EP following the data write-in period DIP. Due to the i-th light emitting control signal Ei, the current path is formed between the power source line PL and the organic light emitting diode ED. Therefore, the organic light emitting diode ED emits the light during the light emitting period EP.

The organic light emitting diode ED emits the light having brightness corresponding to the voltage charged in the storage capacitor Cst. When the data signal Di indicates a black gray-scale level, i.e., a lowest gray-scale value, the organic light emitting diode ED may display a black color without being malfunctioned. This is because the anode of the organic light emitting diode ED of the second pixel PXi is initialized during the data write-in period DIP as described above. In addition, when the data signal Di indicates low gray-scale levels, the organic light emitting diode ED displays the low gray-scale levels each having a set or predetermined brightness against the black color.

In FIG. 3, a set or predetermined delay period exists between the initialization period RP, the data write-in period DIP, and the light emitting period EP, but the initialization period RP, the data write-in period DIP, and the light emitting period EP may be consecutively connected to one another according to embodiments.

Figure 5:
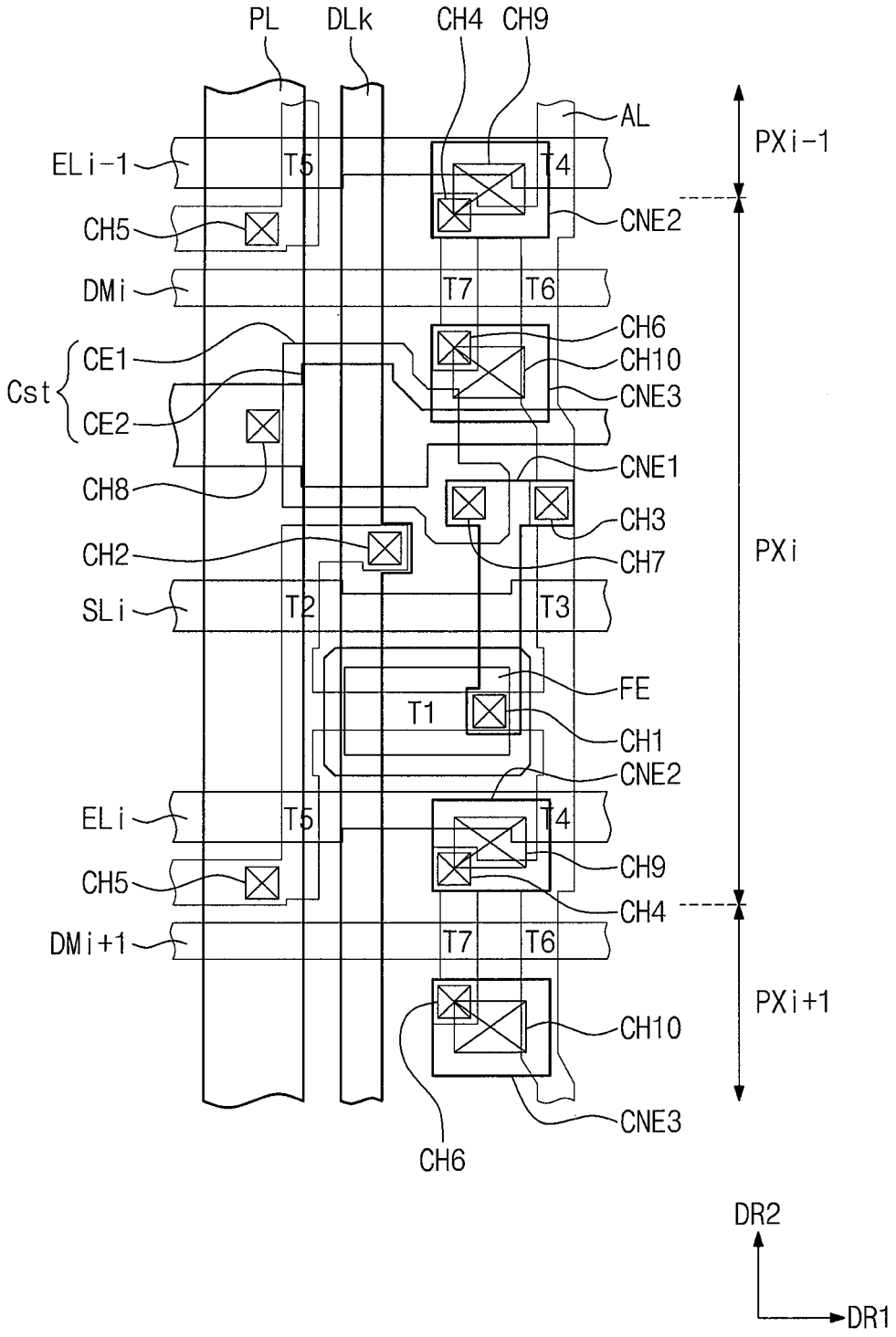
FIG. 5 is a layout diagram showing the i-th pixel according to an exemplary embodiment of the present disclosure.
Figure 6A:
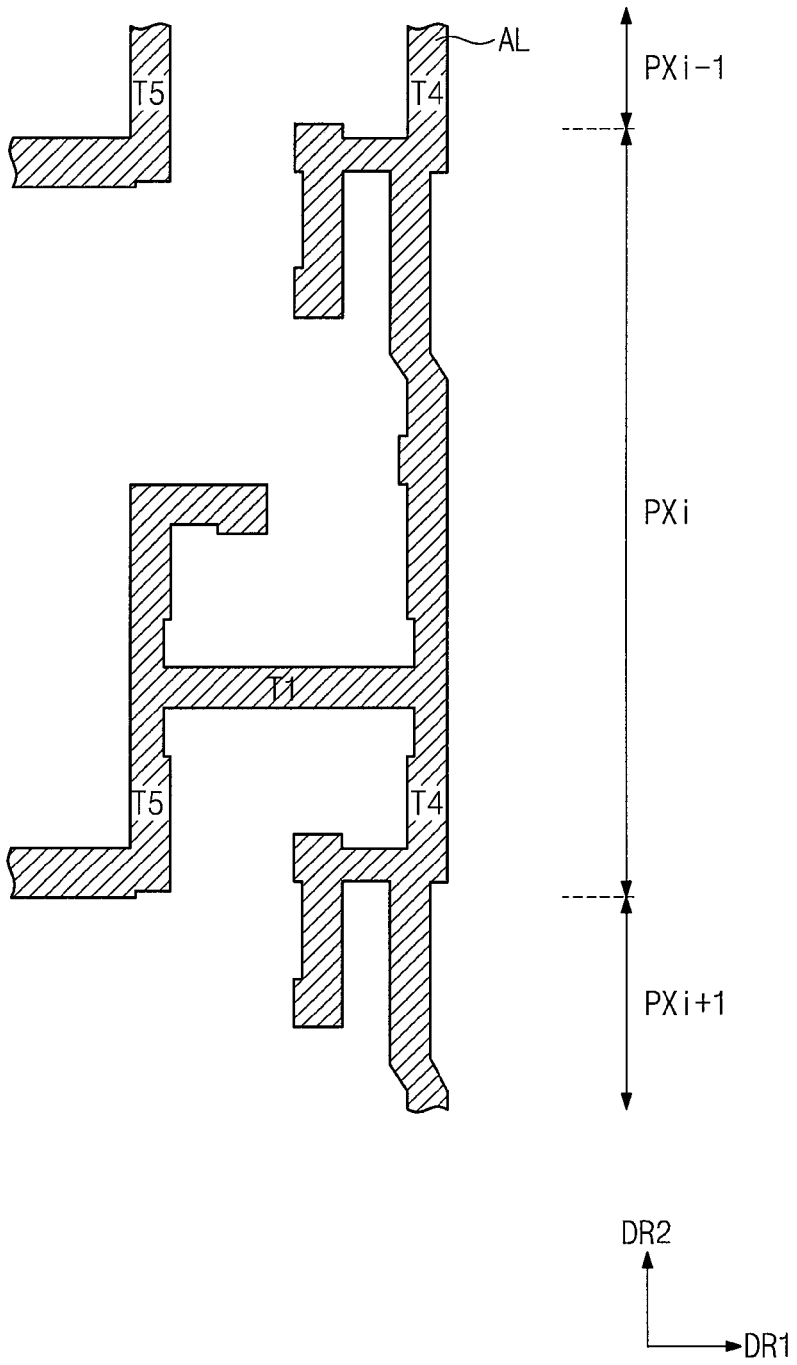
FIGS. 6A to 6G are plan views showing layers included in the i-th pixel shown in FIG. 5, which are formed by a manufacturing process of the i-th pixel.
Figure 6B:
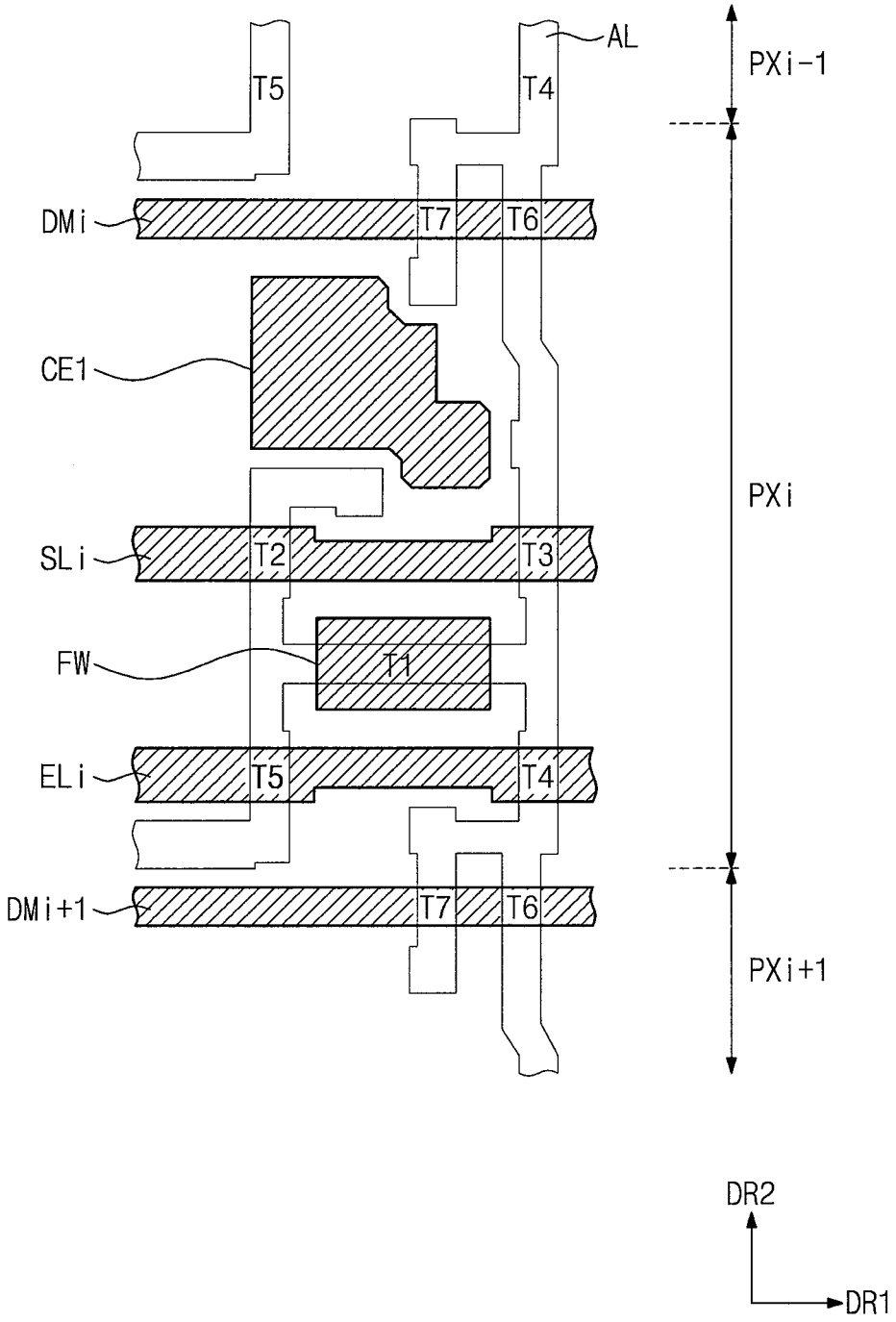
Figure 6C:
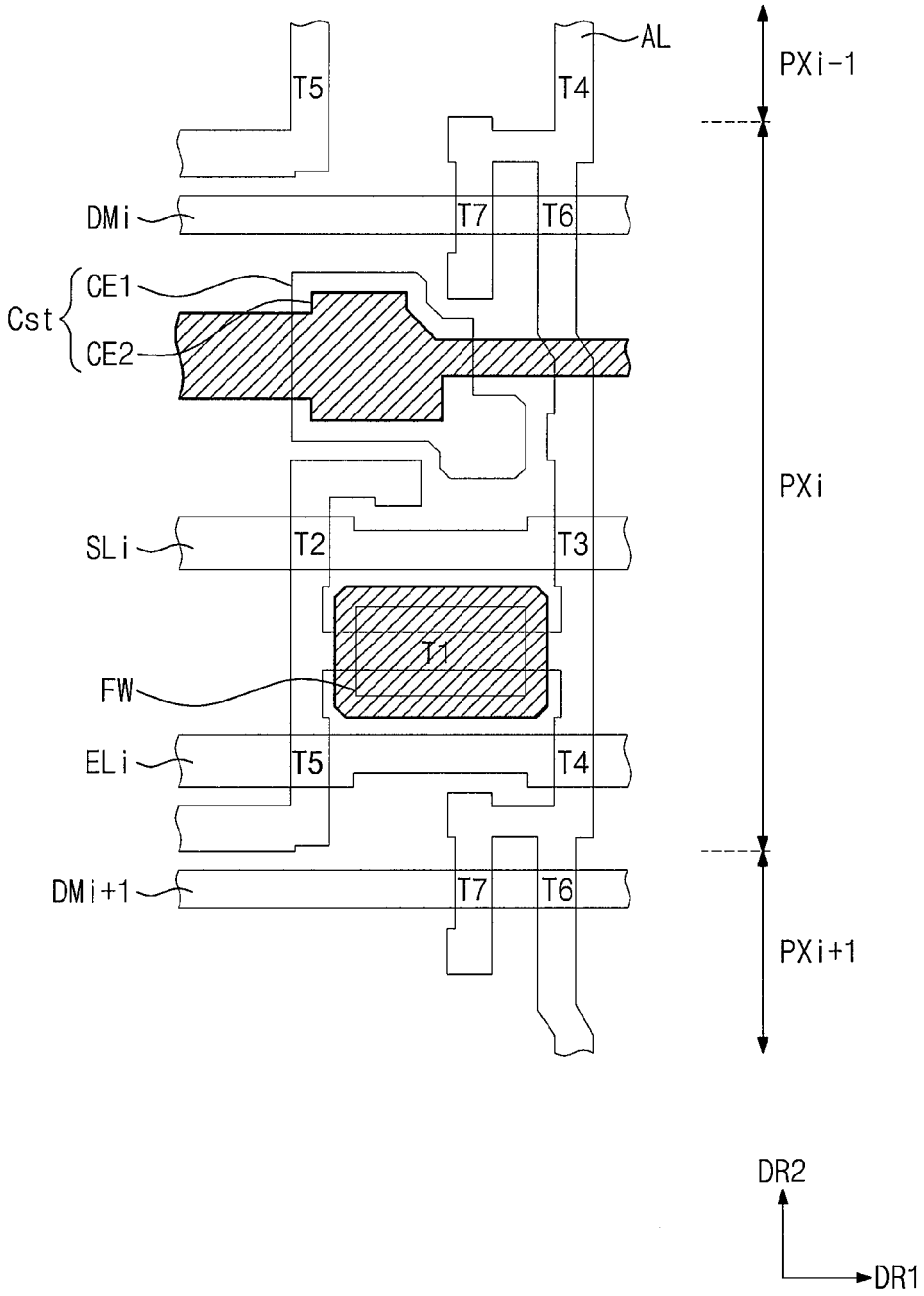
Figure 6D:
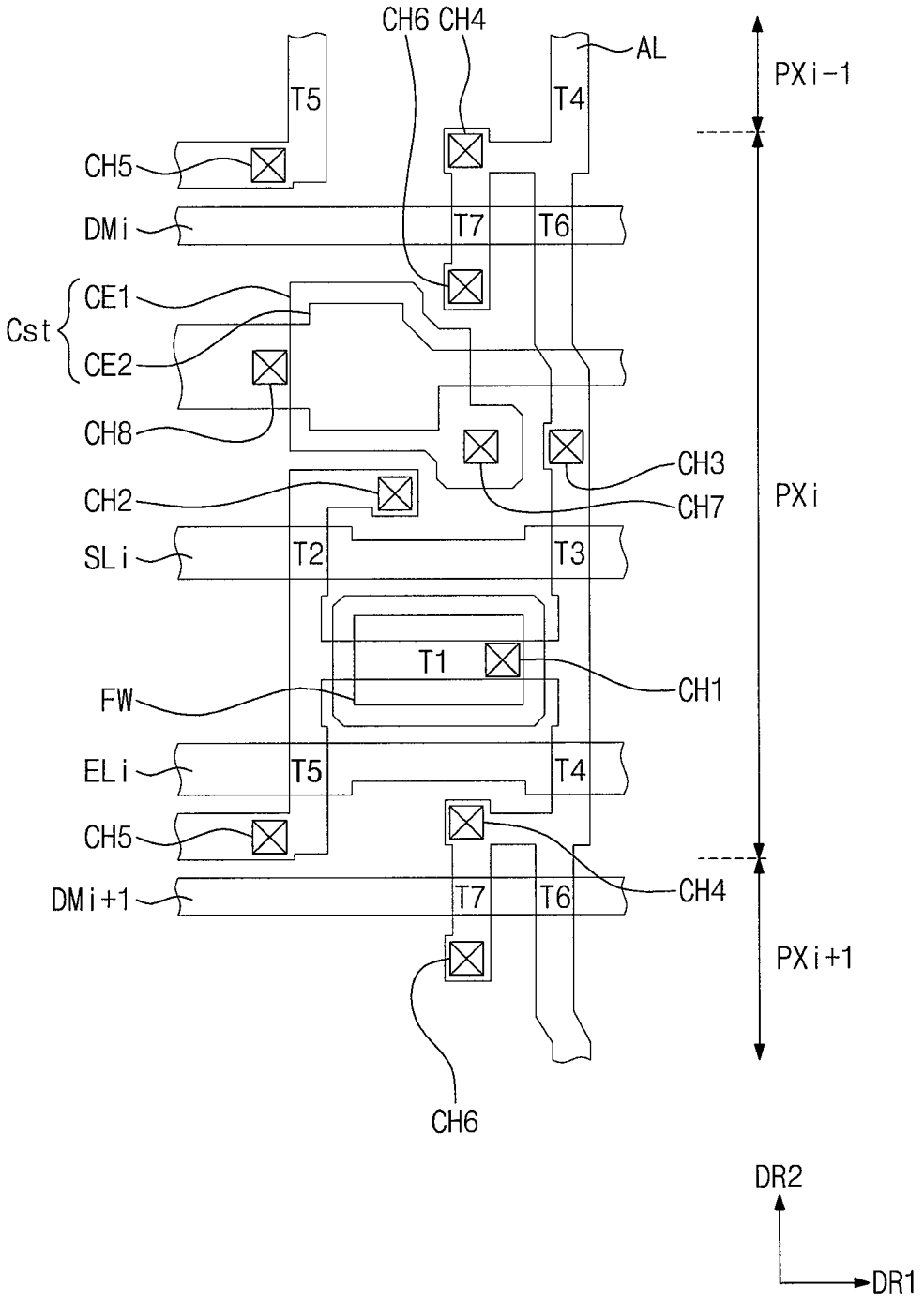
Figure 6E:
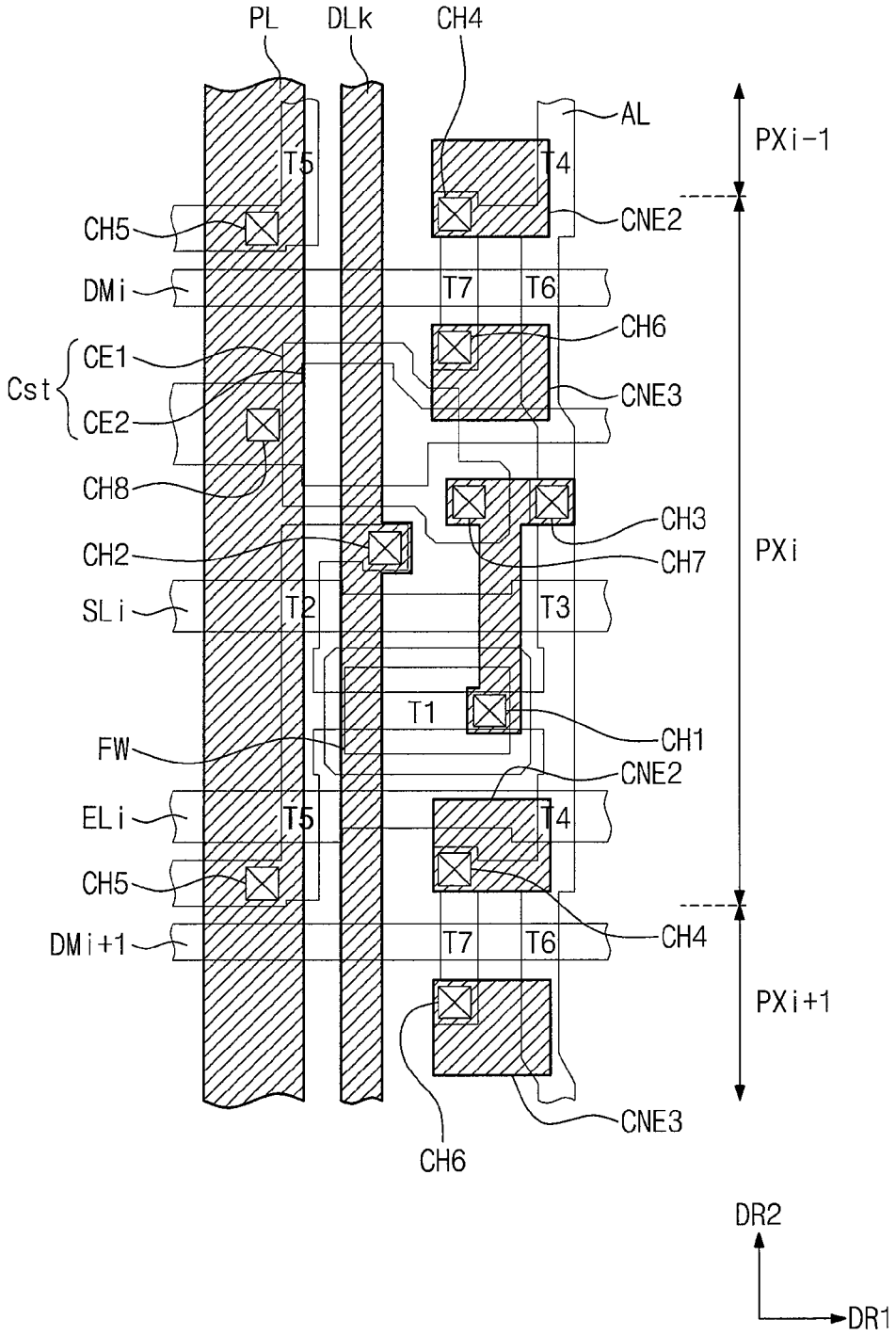
Figure 6F:
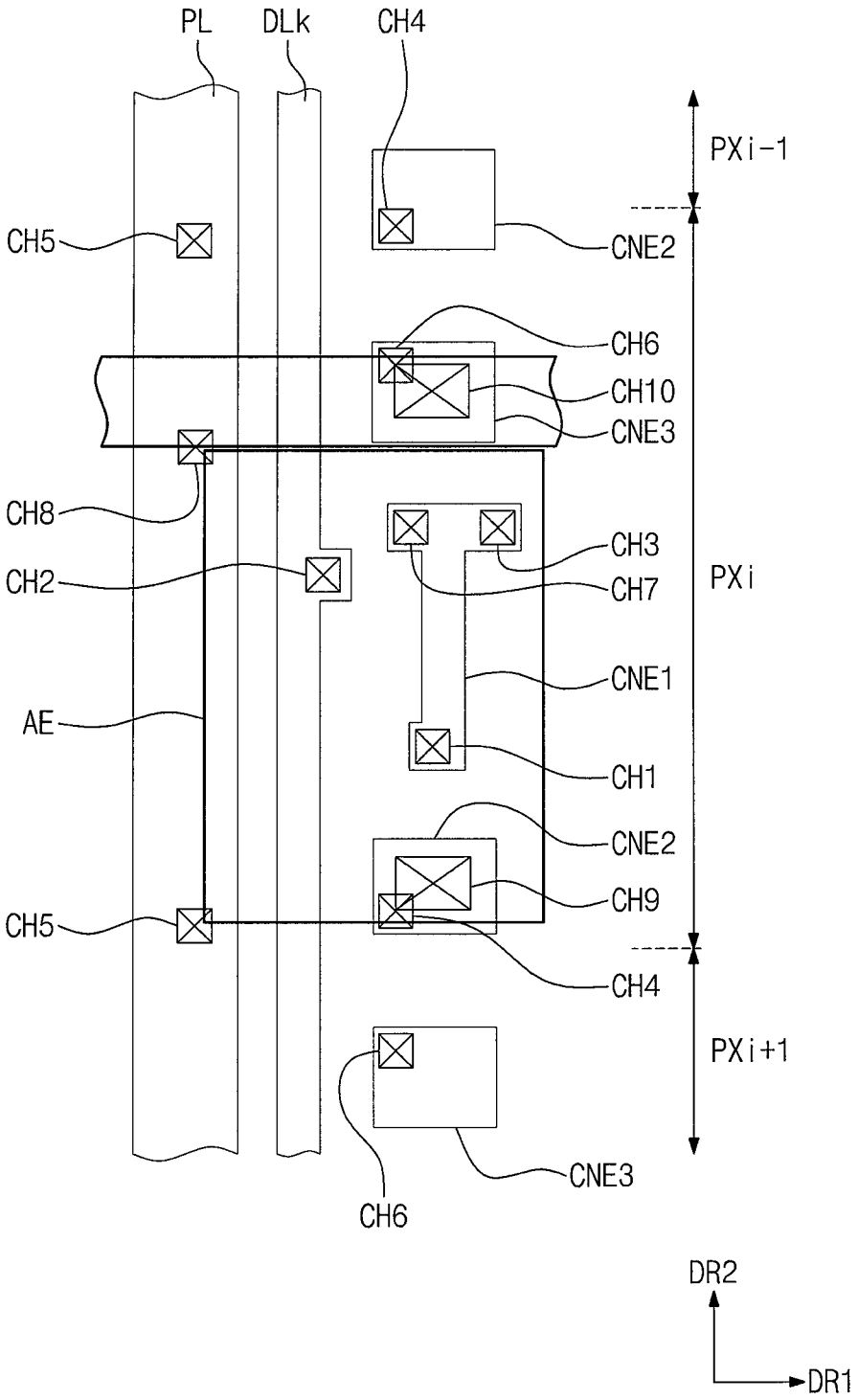
Figure 6G:
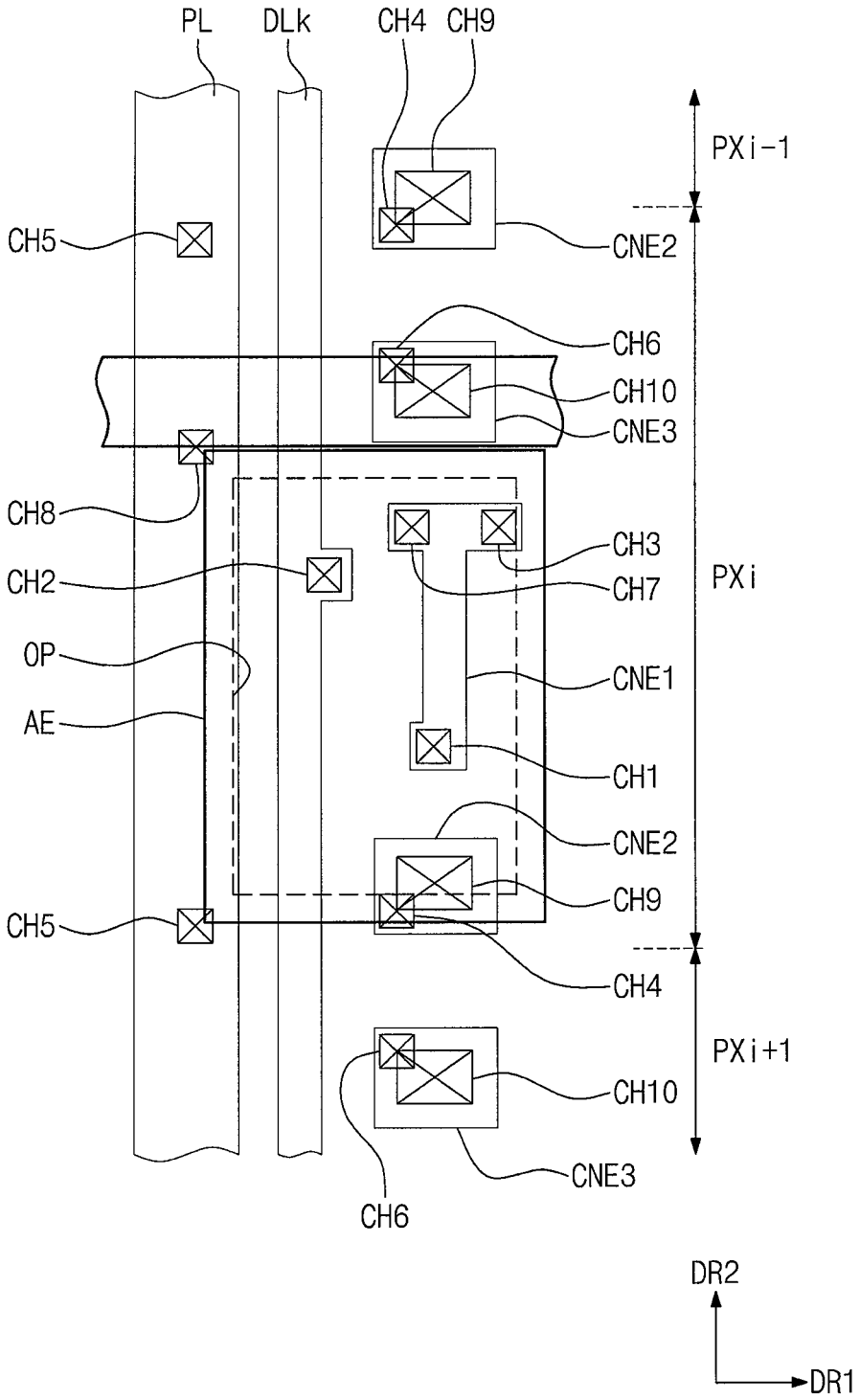
Figure 7A:
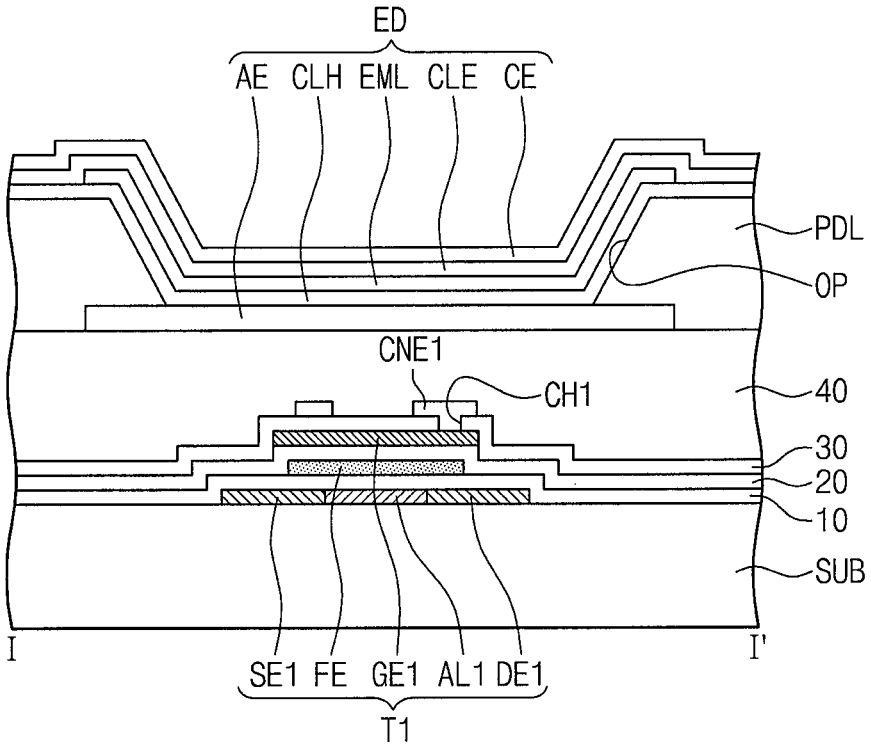
FIG. 7A is a cross-sectional view taken along a line I-I' shown in FIG. 5.
Figure 7B:
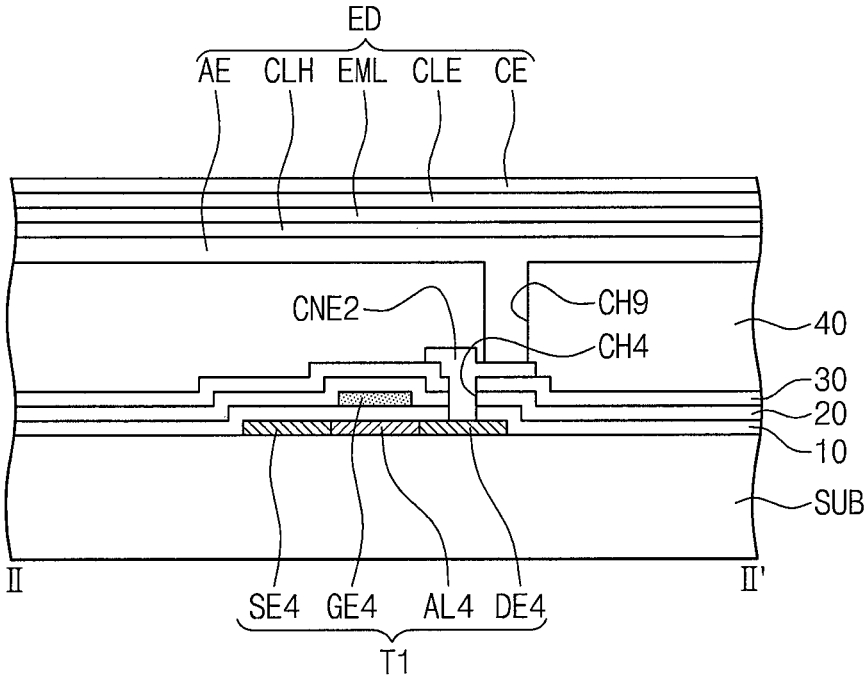
FIG. 7B is a cross-sectional view taken along a line II-II' shown in FIG. 5.

FIG. 5 is a layout diagram showing the i-th pixel according to an exemplary embodiment of the present disclosure, FIGS. 6A to 6G are plan views showing layers included in the i-th pixel shown in FIG. 5, which are formed by a manufacturing process of the i-th pixel, FIG. 7A is a cross-sectional view taken along a line I-I' shown in FIG. 5, and FIG. 7B is a cross-sectional view taken along a line II-II' shown in FIG. 5.

Referring to FIG. 5, the organic light emitting diode ED of the second pixel PXi, the first to seventh transistors T1 to T7, and the storage capacitor Cst are disposed on a base substrate SUB (refer to FIG. 7A). The dummy scan line DMi, the scan line SLi, the light emitting line ELi, the data line DLk, and the power source line PL, which are connected to the second pixel PXi, are disposed on the base substrate SUB. In FIG. 5, the initialization line is not shown, and portions of the first and third pixels PXi−1 and PXi+1 are further shown in FIG. 5.

Referring to FIG. 6A, a semiconductor layer AL is disposed on the base substrate SUB. The semiconductor layer AL has a line shape bent several times (or a shape of a line that is bent several times). In other words, the semiconductor layer AL includes a plurality of line parts connected to each other.

The semiconductor layer AL is divided into channel parts, electrode parts, and line parts. The channel parts have a semiconductor property, and the electrode parts and the line parts have a conductive property. The channel parts define channels of the first to seventh transistors T1 to T7, and the electrode parts define the input electrodes and the output electrodes of the first to seventh transistors T1 to T7. The line parts define signal lines used (utilized) to connect the electrodes of the first to seventh transistors T1 to T7. The channel parts, the electrode parts, and the line parts of the semiconductor layer AL are defined by a doping process and a reduction process, which are described later in more detail.

The semiconductor layer AL includes polysilicon. In this case, the channel parts do not include impurity and the electrode parts and the line parts include impurity. The impurity is determined depending on the kind of the first to seventh transistors T1 to T7, and the impurity may be an n-type (n-channel) impurity or a p-type (p-channel) impurity.

The semiconductor layer AL includes a metal oxide semiconductor. For instance, the metal oxide semiconductor includes a metal oxide, e.g., zinc (Zn), indium (In), gallium (Ga), tin (Sn), titanium (Ti), etc., or a mixture of a metal, such as zinc (Zn), indium (In), gallium (Ga), tin (Sn), titanium (Ti), etc., and an oxide thereof. The channel parts do not include the metal reduced from the metal oxide semiconductor and the electrode parts and the line parts include the metal reduced from the metal oxide semiconductor.

Referring to FIG. 7A, the input electrode SE1, the output electrode DE1, and the channel part AL1 disposed between the input electrode SE1 and the output electrode DE1 of the first transistor T1 are disposed on the base substrate SUB. Referring to FIG. 7B, the input electrode SE4, the output electrode DE4, and the channel part AL4 disposed between the input electrode SE4 and the output electrode DE4 of the fourth transistor T4 are disposed on the base substrate SUB. A barrier layer and/or a buffer layer may also be disposed on the base substrate SUB, and the semiconductor layer AL may be disposed on the barrier layer and/or the buffer layer.

Referring to FIGS. 7A and 7B, a first insulating layer 10 is disposed on the base substrate SUB to cover the channel parts AL1 and AL4. The first insulating layer 10 includes an inorganic material and/or an organic material. The first insulating layer 10 includes a silicon nitride layer and/or a silicon oxide layer.

Referring to FIG. 6B, a first conductive layer is disposed on the first insulating layer 10 (refer to FIGS. 7A and 7B). The first conductive layer includes a first electrode CE1 of the storage capacitor Cst and a floating electrode FE of the first transistor T1. In addition, the first conductive layer includes the dummy scan line DMi, the scan line SLi, and the light emitting line ELi. Portions of the dummy scan line DMi form the control electrode of the sixth transistor T6 and the control electrode of the seventh transistor T7, respectively. Portions of the scan line SLi form the control electrode of the second transistor T2 and the control electrode of the third transistor T3, respectively. Portions of the light emitting line ELi form the control electrode of the fourth transistor T4 and the control electrode of the fifth transistor T5.

As shown in FIG. 7A, the floating electrode FE overlapped with the channel part AL1 of the first transistor T1 is disposed on the first insulating layer 10, and the control electrode GE4 overlapped with the channel part AL4 of the fourth transistor T4 is disposed on the first insulating layer 10. The channel parts of the transistors, which include the channel part AL1 of the first transistor T1 and the channel part AL4 of the fourth transistor T4, are formed by performing the doping process or the reduction process after the first conductive layer is formed.

When the semiconductor layer AL includes polysilicon, the semiconductor layer AL is doped with impurities after the first conductive layer is formed. Accordingly, portions of the semiconductor layer AL except for the portion overlapped with the first conductive layer have the conductive property. When the semiconductor layer AL includes the metal oxide semiconductor, the semiconductor layer AL is reduced after the first conductive layer is formed. Therefore, the metals are reduced in the portions of the semiconductor layer AL except for the portion overlapped with the first conductive layer and the portions of the semiconductor layer AL have the conductive property.

As shown in FIGS. 7A and 7B, a second insulating layer 20 is disposed on the base substrate SUB to cover the floating electrode FE of the first transistor T1 and the control electrode GE4 of the fourth transistor T4. The second insulating layer 20 includes an inorganic material and/or an organic material. The second insulating layer 20 includes a silicon nitride layer and/or a silicon oxide layer.

Referring to FIG. 6C, a second conductive layer is disposed on the second insulating layer 20 (refer to FIGS. 7A and 7B). The second conductive layer includes a second electrode CE2 of the storage capacitor Cst and the control electrode GE1 (refer to FIG. 7A) of the first transistor T1. As shown in FIG. 7A, the control electrode GE1 overlapped with the floating electrode FE of the first transistor T1 is disposed on the second insulating layer 20. The control electrode GE1 of the first transistor T1 is fully overlapped with the floating electrode FE and has an area greater than that of the floating electrode FE. When the control electrode GE1 of the first transistor T1 is applied with the control signal and the channel part ALA is activated, a channel characteristic of the first transistor T1 becomes stable due to the floating electrode FE. Thus, the first transistor T1 may apply driving currents corresponding to data signals having different gray-scale values to the organic light emitting diode ED.

Referring to FIGS. 7A and 7B, a third insulating layer 30 is disposed on the base substrate SUB to cover the second electrode CE2 of the storage capacitor Cst and the control electrode GE1 of the first transistor T1. The third insulating layer 30 includes an inorganic material and an organic material. The third insulating layer 30 includes a silicon nitride layer and/or a silicon oxide layer.

Referring to FIG. 6D, a plurality of contact holes CH1 to CH8 formed through at least the third insulating layer 30 (refer to FIGS. 7A and 7B) is defined. The contact holes CH1 to CH8 are formed penetrating through at least one of the first, second, and third insulating layers 10, 20, and 30.

As shown in FIG. 7A, a first contact hole CH1 is formed penetrating through the third insulating layer 30. The first contact hole CH1 exposes a portion of the control electrode GE1 of the first transistor T1. As shown in FIG. 7B, a fourth contact hole CH4 is formed penetrating through the first to third insulating layers 10 to 30. The fourth contact hole CH4 exposes a portion of the output electrode DE4 of the fourth transistor T4.

Although not shown in figures, a second contact hole CH2, a third contact hole CH3, a fifth contact hole CH5, and a sixth contact hole CH6 are formed penetrating through the first to third insulating layers 10 to 30 as the fourth contact hole CH4. An eighth contact hole CH8 is formed penetrating through the third insulating layer 30 as the first contact hole CH1. A seventh contact hole CH7 is formed penetrating through the second and third insulating layers 20 and 30.

Referring to FIG. 6E, a third conductive layer is disposed on the third insulating layer 30 (refer to FIGS. 7A and 7B). The third conductive layer includes the data line DLk, the power source line PL, and first to third connection lines CNE1 to CNE3. The data line DLk is connected to the input electrode of the second transistor T2 through the second contact hole CH2. The power source line PL is connected to the second electrode CE2 of the storage capacitor Cst through the eighth contact hole CH8 and connected to the input electrode of the fifth transistor T5 through the fifth contact hole CH5.

Referring to FIGS. 6E and 7A, the first connection electrode CNE1 connects the control electrode GE1 of the first transistor T1 and the first electrode CE1 of the storage capacitor Cst through the first and seventh contact holes CH1 and CH7. The first connection electrode CNE1 connects the first electrode CE1 of the storage capacitor Cst and the output electrode of the third transistor T3 through the seventh and third contact holes CH7 and CH3.

Referring to FIGS. 6E and 7B, the second connection electrode CNE2 is connected to the output electrode DE4 of the fourth transistor T4 through the fourth contact hole CH4. As shown in FIG. 6E, the third connection electrode CNE3 is connected to the output electrode of the seventh transistor T7 through the sixth contact hole CH6.

As shown in FIGS. 7A and 7B, a fourth insulating layer 40 is disposed on the base substrate SUB to cover the third conductive layer. The fourth insulating layer 40 includes an inorganic material and/or an organic material. In one embodiment, the fourth insulating layer 40 includes an organic layer to provide a flat surface.

Referring to FIG. 6F, a ninth contact hole CH9 and a tenth contact hole CH10 are formed through the fourth insulating layer 40. In addition, a fourth conductive layer is disposed on the fourth insulating layer 40. The fourth conductive layer includes the initialization line RL and the anode AE. For the convenience of explanation, FIG. 6F shows only a portion of elements shown in FIG. 6E.

As shown in FIGS. 6F and 7B, the anode AE is connected to the second connection electrode CNE2 through the ninth contact hole CH9. As shown in FIG. 6F, the initialization line RL is connected to the third connection line CNE3 through the tenth contact hole CH10.

Referring to FIGS. 6G and 7A, a pixel definition layer PDL is disposed on the fourth insulating layer 40. The pixel definition layer PDL is provided with an opening OP formed therethrough to expose the anode AE. The organic light emitting layer EML is disposed on the anode AE to overlap with the opening OP. The cathode CE is disposed on the organic light emitting layer EML.

A first common layer CLH is disposed between the anode AE and the organic light emitting layer EML. A second common layer CLE is disposed between the organic light emitting layer EML and the cathode CE. The first and second common layers CLH and CLE are commonly disposed on the pixels PX (refer to FIG. 1). The cathode CE is commonly disposed on the pixels PX (refer to FIG. 1). That is, the first common layer CLH of the pixels PX (refer to FIG. 1) may be integrally formed as a single unitary and individual unit. At least one of the first and second common layers CLH and CLE may be omitted.

The first common layer CLH includes at least a hole injection layer, and the second common layer CLE includes at least an electron injection layer. The first common layer CLH further includes a hole transport layer disposed between the hole injection layer, and the organic light emitting layer EML and the second common layer CLE further includes an electron transport layer disposed between the electron injection layer and the organic light emitting layer EML. The first and second common layers CLH and CLE may further include functional layers.

Although not shown in figures, a sealing layer may be disposed on the cathode CE to cover the organic light emitting diode ED. The sealing layer includes a plurality of inorganic layers. In addition, the color filters are disposed on the base substrate SUB.

Figure 8:
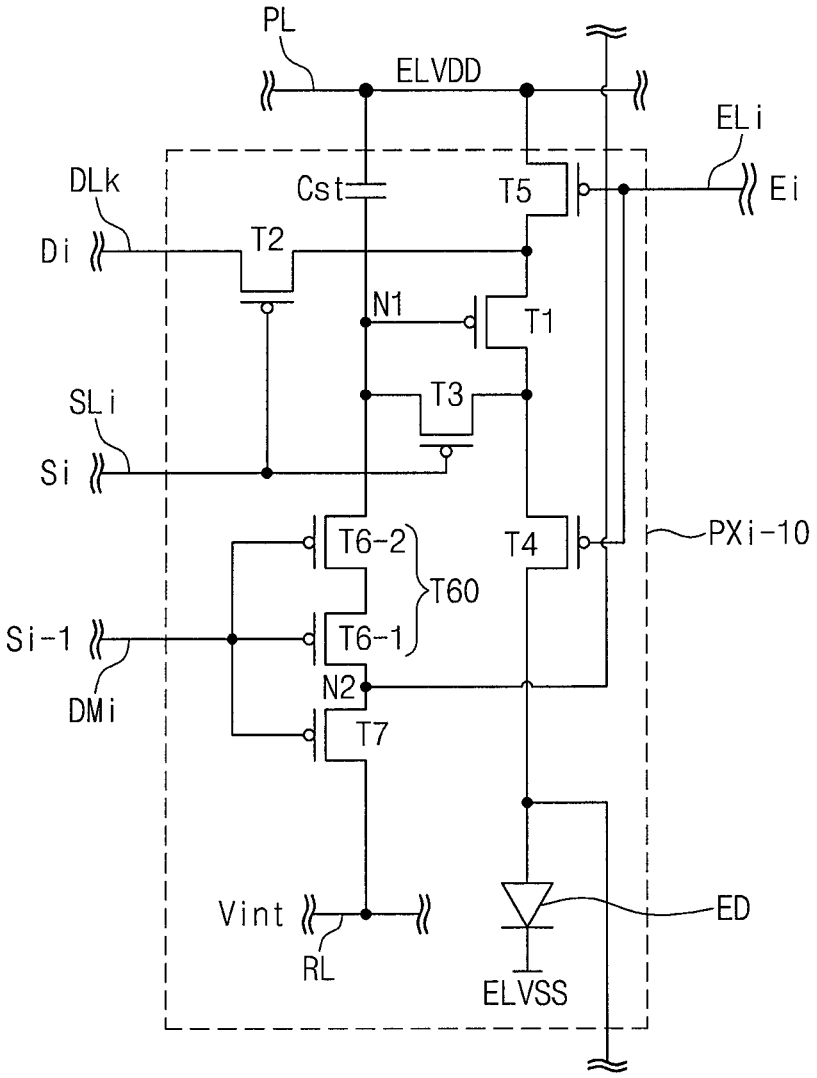
FIG. 8 is an equivalent circuit diagram showing an i-th pixel according to an exemplary embodiment of the present disclosure.
Figure 9:
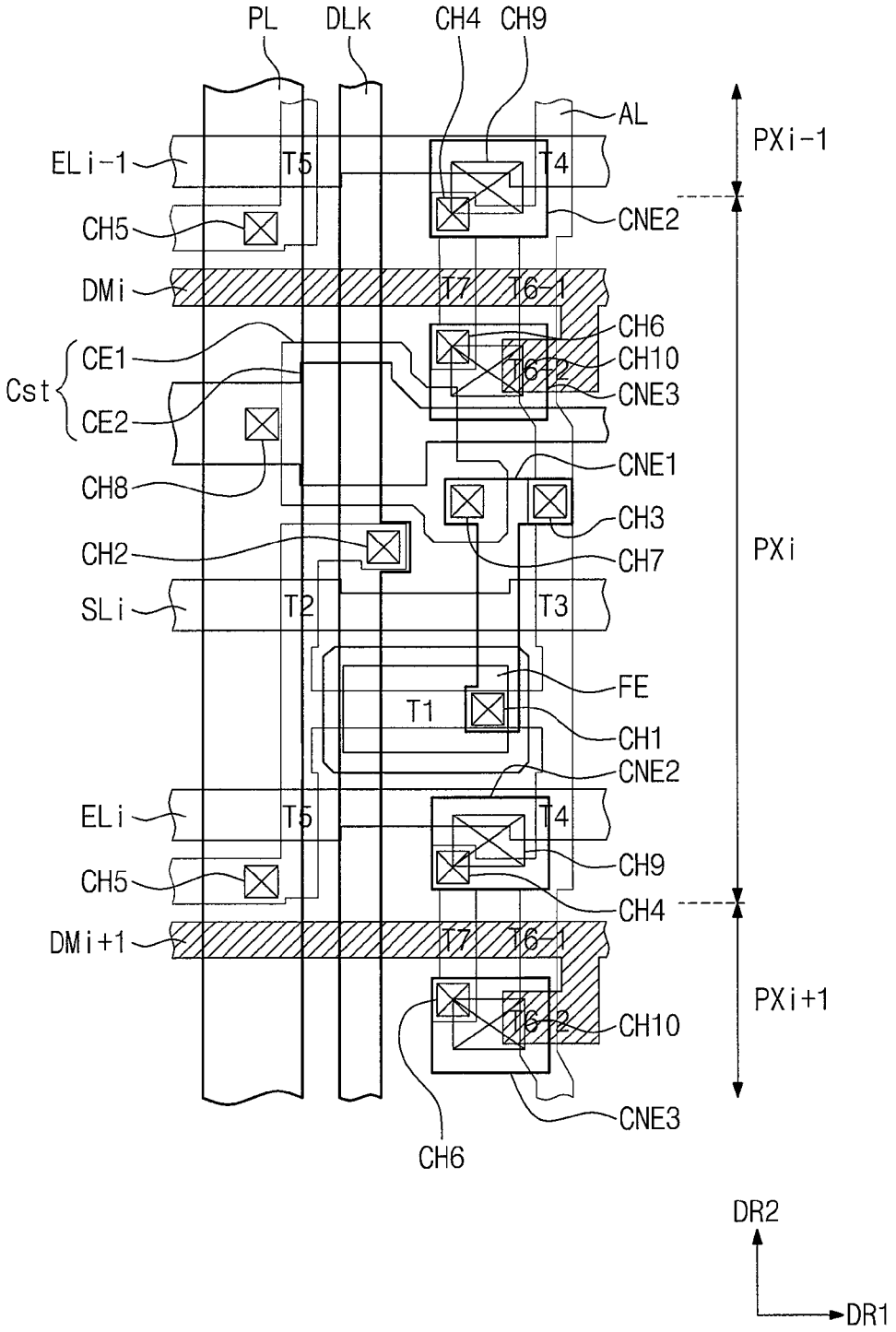
FIG. 9 is a plan view showing a portion of a layout of the i-th pixel shown in FIG. 8.

FIG. 8 is an equivalent circuit diagram showing an i-th pixel according to an exemplary embodiment of the present disclosure, and FIG. 9 is a plan view showing a portion of a layout of the i-th pixel shown in FIG. 8. Hereinafter, the organic light emitting display device will be described in more detail with reference to FIGS. 8 and 9. In FIGS. 8 and 9, the same reference numerals denote the same elements in FIGS. 1 to 7B, and thus detailed descriptions of the same elements will be omitted.

A pixel PXi−10 is operated in the same way as the pixel PXi described with reference to FIGS. 4A to 4C. The pixel PXi−10 has the same structure as that of the pixel PXi described with reference to FIGS. 4A to 4C except for a sixth transistor T6.

Referring to FIG. 8, the transistor T60 of the pixel PXi−10 includes two transistors T6-1 and T6-2 connected to each other in series. After the initialization period RP (refer to FIG. 3), the first and second nodes N1 and N2 are electrically opened. The two transistors T6-1 and T6-2 increase resistance between the first and second nodes N1 and N2. Accordingly, after the initialization period RP (refer to FIG. 3), the first node N1 is not influenced by the electric potential of the second node N2, and thus the electric potential of the first node N1 becomes stable.

Referring to FIG. 9, a control electrode of one of the two transistors T6-1 and T6-2 corresponds to a portion of the dummy scan line DMi. A control electrode of the other of the two transistors T6-1 and T6-2 is branched from the dummy scan line DMi.

When compared to the pixel PXi shown in FIG. 5, the control electrode of the other of the two transistors T6-1 and T6-2, which is connected to the control electrode of the one of the two transistors T6-1 and T6-2, may be further formed during the process of patterning the first conductive layer. That is, the sixth transistor T60 including the two transistors T6-1 and T6-2 connected to each other in series may be formed without additional process.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed, and equivalents thereof.

What is claimed is:

1. An organic light emitting display device comprising:
an (i−1)th pixel connected to an (i−1)th scan line;
an i-th pixel connected to an i-th scan line; and
an (i+1)th pixel connected to an (i+1)th scan line,
wherein the "i" is a natural number equal to or greater than 2,
each of the (i−1)th pixel, the i-th pixel, and the (i+1)th pixel comprises an organic light emitting diode, a driving transistor configured to control a driving current flowing through the organic light emitting diode, and a first initialization transistor,
a first node of the i-th pixel, to which a control electrode of the driving transistor of the i-th pixel is connected, is configured to be initialized to an initialization voltage of the i-th pixel in synchronization with an (i−1)th scan signal applied to the i-th pixel, and
the first initialization transistor of the (i+1)th pixel is connected to an anode of the organic light emitting diode of the i-th pixel, and the first initialization transistor of the (i+1)th pixel is configured to apply the initialization voltage of the (i+1)th pixel to the anode of the organic light emitting diode of the i-th pixel in synchronization with an i-th scan signal.

2. The organic light emitting display device of claim 1, wherein:
the i-th pixel further comprises a second initialization transistor, the first initialization transistor and the second initialization transistor of the i-th pixel are connected between an i-th initialization line configured to be applied with the initialization voltage of the i-th pixel and the first node of the i-th pixel in series, the first and second initialization transistors of the i-th pixel configured to apply the initialization voltage of the i-th pixel to the first node of the i-th pixel in response to the (i−1)th scan signal applied to an i-th dummy scan line.

3. The organic light emitting display device of claim 2, wherein a first node of the (i+1)th pixel, to which a control electrode of the driving transistor of the (i+1)th pixel is connected, is configured to be initialized to the initialization voltage of the (i+1)th pixel in synchronization with the i-th scan signal applied to the (i+1)th pixel.

4. The organic light emitting display device of claim 3, wherein:

the (i+1)th pixel further comprises a second initialization transistor, the first initialization transistor and the second initialization transistor of the (i+1)th pixel are connected between an (i+1)th initialization line applied with the initialization voltage of the (i+1)th pixel and the first node of the (i+1)th pixel in series, a second node of the (i+1)th pixel, which is connected to the anode of the organic light emitting diode of the i-th pixel, is defined between the first and second initialization transistors of the (i+1)th pixel, the first initialization transistor of the (i+1)th pixel is configured to apply the initialization voltage of the (i+1)th pixel to the second node of the (i+1)th pixel in response to the i-th scan signal applied to the (i+1)th pixel, and the anode of the organic light emitting diode of the i-th pixel is connected to the second node of the (i+1)th pixel.

5. The organic light emitting display device of claim 2, wherein:

a second node of the i-th pixel, which is connected to the anode of the organic light emitting diode of the (i−1)th pixel, is defined between the first and second initialization transistors of the i-th pixel, and the anode of the organic light emitting diode of the (i−1)th pixel is configured to be initialized to the initialization voltage of the i-th pixel in synchronization with the (i−1)th scan signal applied to the i-th pixel.

6. The organic light emitting display device of claim 5, wherein the second initialization transistor of the i-th pixel comprises two transistors connected between the second node of the i-th pixel and the first node of the i-th pixel.

7. The organic light emitting display device of claim 2, wherein the i-th pixel comprises:

a switching transistor comprising an input electrode connected to a k-th (k is a natural number equal to or greater than 1) data line, an output electrode connected to an input electrode of the driving transistor, and a control electrode connected to the i-th scan line applied with the i-th scan signal;

a storage capacitor connected between the first node and a power source line;

a first control transistor comprising an input electrode connected to an output electrode of the driving transistor, an output electrode connected to the first node, and a control electrode connected to the i-th scan line applied with the i-th scan signal; and a second control transistor comprising an input electrode connected to the output electrode of the driving transistor, an output electrode connected to the anode of the organic light emitting diode, and a control electrode connected to an i-th light emitting line.

8. The organic light emitting display device of claim 7, wherein the i-th pixel further comprises a third control transistor comprising an input electrode connected to the power source line, an output electrode connected to the input electrode of the driving transistor, and a control electrode connected to the i-th light emitting line.

9. The organic light emitting display device of claim 8, wherein a period in which the (i−1)th scan signal applied to the i-th dummy scan line is activated corresponds to an initialization period, a period in which the i-th scan signal applied to the i-th scan line is activated corresponds to a data write-in period after the initialization period, and the storage capacitor is configured to be charged with a voltage corresponding to a data signal applied to the k-th data line during the data write-in period.

10. The organic light emitting display device of claim 9, wherein a period in which a light emitting control signal applied to the i-th light emitting line is activated corresponds to a light emitting period after the initialization period, and the organic light emitting diode of the i-th pixel is configured to emit a light in response to the voltage charged in the storage capacitor during the light emitting period.

11. The organic light emitting display device of claim 7, wherein a channel part of the driving transistor is disposed between the input electrode of the driving transistor and the output electrode of the driving transistor, disposed on a same layer as the input and output electrodes of the driving transistors, and overlapped with the control electrode of the driving transistor.

12. The organic light emitting display device of claim 11, wherein the storage capacitor comprises:

a first electrode disposed on a first insulating layer that covers the input electrode, the output electrode, and the channel part of the driving transistor; and a second electrode disposed on a second insulating layer that covers the first electrode and is connected to the power source line.

13. The organic light emitting display device of claim 12, wherein the driving transistor further comprises a floating electrode disposed on a same layer as the first electrode and overlapped with the control electrode of the driving transistor.

14. The organic light emitting display device of claim 13, wherein the control electrode of the driving transistor is disposed on a same layer as the second electrode.

15. The organic light emitting display device of claim 14, wherein:

the i-th pixel comprises a first connection electrode to connect the control electrode of the driving transistor and the first electrode of the storage capacitor, the first connection electrode is disposed on a third insulating layer that covers the control electrode of the driving transistor, the first connection electrode is connected to the control electrode of the driving transistor through a first contact hole defined in the third insulating layer, and the first connection electrode is connected to the first electrode of the storage capacitor through a second contact hole defined in the third and second insulating layers.

16. The organic light emitting display device of claim 15, wherein:

the i-th pixel further comprises a second connection electrode connected to an output electrode of the second control transistor, the output electrode of the second control transistor is disposed on a same layer as the output electrode of the driving transistor, the second connection electrode is disposed on the third insulating layer, and the second connection electrode is connected to the output electrode of the second control transistor through a third contact hole defined in the first, second, and third insulating layers.

17. The organic light emitting display device of claim 16, wherein:

the anode of the organic light emitting diode is disposed on a fourth insulating layer that covers the second connection electrode, and the second connection electrode is connected to the anode of the organic light emitting diode through a fourth contact hole defined in the fourth insulating layer.

* * * * *